United States Patent [19]

Hauber

[11] Patent Number: 4,898,408

[45] Date of Patent: Feb. 6, 1990

[54] SAFE AND SECURE CAMPER SHELL DOOR LATCH

[76] Inventor: Peter Hauber, 9001 N. Glenoaks, Sun Valley, Calif. 91352

[21] Appl. No.: 238,208

[22] Filed: Aug. 30, 1988

Related U.S. Application Data

[63] Continuation of Ser. No. 431,568, Sep. 30, 1982, abandoned.

[51] Int. Cl.[4] ..... F05C 5/00; F05B 5/02

[52] U.S. Cl. ..... 292/7; 70/208; 292/DIG. 29; 292/DIG. 31; 292/21; 292/66

[58] Field of Search ..... 70/208, 210, 114, 224, 70/116; 292/DIG. 31, DIG. 36, 7, 21, 92, 40, 42, 66, DIG. 29

[56] References Cited

U.S. PATENT DOCUMENTS

| | | | |
|---|---|---|---|
| 1,495,820 | 5/1924 | Tierney | 292/DIG. 62 X |
| 1,858,804 | 5/1932 | Carlson | 292/DIG. 36 X |
| 1,937,730 | 12/1933 | Triller | 292/DIG. 36 X |
| 2,124,970 | 7/1938 | Bagley | 292/DIG. 36 X |
| 2,188,532 | 1/1940 | Dominguez | 292/36 |
| 2,223,236 | 11/1940 | Barrington et al. | 70/208 |
| 2,246,708 | 6/1941 | Wieben | 70/208 |
| 2,375,837 | 5/1945 | Buehner | 292/DIG. 36 X |
| 2,377,301 | 5/1945 | Rolph | 70/208 |
| 2,628,117 | 2/1953 | Robinson | 292/DIG. 36 X |
| 3,177,022 | 4/1965 | McKee et al. | 292/DIG. 36 X |
| 3,683,652 | 8/1972 | Halopoff et al. | 292/DIG. 36 X |
| 3,745,796 | 7/1973 | Fleming | 70/208 X |
| 4,015,454 | 4/1977 | Struble | 292/36 X |
| 4,370,874 | 2/1983 | Munn | 292/DIG. 31 X |
| 4,438,963 | 3/1984 | Friedrich | 292/146 |
| 4,470,278 | 9/1984 | Hale et al. | 292/169.18 |

FOREIGN PATENT DOCUMENTS

| | | | |
|---|---|---|---|
| 571427 | 5/1924 | France | 70/210 |

*Primary Examiner*—Gary L. Smith
*Assistant Examiner*—Eric K. Nicholson
*Attorney, Agent, or Firm*—Louis J. Bachand

[57] ABSTRACT

A latch for a camper shell door in which the inside pull is operable to unlatch or latch the door whether or not the latch is locked from the outside, thereby giving the occupants of the shell the security of a locked environment, and the safety of ready unlatching from within.

6 Claims, 2 Drawing Sheets

SAFE AND SECURE CAMPER SHELL DOOR LATCH

This is a continuation of Ser. No. 431,568, filed 9/30/82, now abandoned.

TECHNICAL FIELD

This invention relates to a latch useful in latching and locking camper shell doors and the like, and more particularly is concerned with a latch system for a camper shell door or the like in which the door may be locked from without, but the interior latch arms operated from within free of need of unlocking the door lock.

Camper shells are enclosures fitted to the beds of pick-up trucks to provide a weather-tight living place for campers, hunters and the like. Typically, a camper shell has a roof and side-walls and a rear door which mates with the pick-up tail gate. The front of the shell mates with the cab of the truck.

BACKGROUND

Presently, camper shell doors pivot on overhead hinges to permit access to the shell interior. The shell door is locked by interior arms which extend across the width of the door in a retracted condition and which are extendible outward in guided manner beyond the door to engage a keeper on either side of the door, generally just the shell frame surrounding the door. Extension and retraction of the locking arms is by central handles or pulls on the inside and outside of the door. Rotation of the handles turns a shaft which extends through the door and depending on the direction of shaft rotation retracts or extends the arms and unlocks or locks the door relative to the camper shell body. The outside handle is lockable with a key to secure the shell against unwanted entry. The interior handle or pull, however, is not lockable, but is slaved to the locked or unlocked condition of the outside handle.

This situation means that when the camper shell is used for overnight accommodation, the occupants must leave the shell door unlocked for convenience of entry or exit, or locked and enter through the truck rear window if possible. Even if the camper shell is accessible from the truck cab, the ever present danger of fire militates against locking oneself within the shell by barring the easy exit route. The alternative, leaving the shell unlocked, exposes the occupants to intrusion by undesirable persons.

DESCRIPTION OF THE INVENTION

There is a need therefore for an improved camper shell locking means. It is an object of the present invention to provide a camper shell locking system which is reliably and securely lockable at the outside, but openable easily from the inside, without need of unlocking the door at the outside. It is another object to provide a latch which is useful in shell door latching and other applications, and which is openable from one side whether or not locked on the other side, by carrying the latching arms on a rotatable member which can be driven by the outside handle in latching or unlatching movement, and locked against unwanted movement from the outside, but which remains movable from the inside. It is another object to provide flushmount housing for said locking system. It is a highly particular object to provide an inside pull which is rotatable in latching arm translating relation free of blocking engagement with a shaft carrying the pull, while the pull is rotatable from without if unlocked and not so rotatable if locked.

These and other objects of the invention to become apparent hereinafter, are realized by the provision in accordance with the invention of a security latch for camper shell doors and the like, comprising a rotatable shaft adapted to extend through the door to be latched, an outside handle for rotating the shaft, an outside lock assembly for selectively blocking shaft rotation, an inside pull journaled on the shaft, and latch means carried by the inside pull for latching and unlatching translational movement reversibly upon rotation of the inside pull by the shaft, the pull and shaft having opposed cooperating portions permitting rotation of the pull and corresponding translational movement of the latch means independent of shaft rotation, whereby the door can be unlatched and relatched from within the camper shell while remaining continuously locked at the outside handle and lock assembly.

In particular embodiments, the inside pull is T-shaped, the latch means comprises a pair of left and right latch arms adapted to engage keeper means beyond the door in the locked condition of the door, the latch arms are pivotally connected to the inside pull for angular movement about the axis of the shaft, the outside handle is fixed to the shaft in shaft corotating relation, the lock assembly comprises a yoke movable in and out of a keyed engagement with an opposing portion of the shaft, and there is further included key operated means for shifting the yoke in and out of the engagement with the shaft respectively to lock and unlock the same.

In such and like embodiments, there is also included: a shaft-passing outside housing adapted to be secured to the door, the outside handle being pivotally mounted to the shaft for angular movement into the housing respectively for protection and out from the housing for handle manipulation to rotate the shaft and the inside pull thereby; compression spring means centered on the shaft between the housing and the yoke biasing the handle toward the housing; and the housing typically including a mounting boss for the spring centering the spring on the boss.

In more particularly preferred embodiments of the invention: the inside pull is generally T-shaped and has arms carrying the latch means in pivoted relation, the opposed cooperating shaft and pull portions comprise a rectangular bore formed in the leg of the T-shaped pull and a cooperating bore-noncongruent portion on the shaft journals the pull on the shaft for rotation in a limited arc freely of rotation blocking engagement with the shaft, the limited arc permitting translation of latch means into and out of latching engagement with the camper shell, independent of the locked or unlocked condition of the latch; preferably the shaft and pull bore are coaxial rectangles, the shaft being locally and longitudinally alternate-corner beveled within the pull bore, the pull bore being relatively transversely elongated to accommodate rotation of the pull upon the shaft beveled portion over the extent of the arc; the shaft is elliptical in cross-section within the pull bore, and has a major axis substantially the same length as the major axis of the bore and substantially greater than the minor axis of the bore; the outside handle is fixed to the shaft in shaft corotating relation; the lock assembly comprises a yoke movable in and out of a keyed engagement with an opposing portion of the shaft longitudinally displaced from the elliptical portion of the shaft, and key operated means are provided for shifting the yoke in and out of the engagement with the shaft respectively to lock and unlock the same; there is further included a shaft-passing outside housing adapted to be secured to the door, the outside handle being pivotally mounted to the shaft for angular movement relative to the plane of the housing respectively for protection and for handle manipulation to rotate the shaft and the inside pull thereby; a compression spring means is centered on the shaft between the housing and the yoke to bias the handle toward the housing; and the latch means comprise a pair of right and left hand arms, the door having arm guides thereon, the inside pull being secured to the shaft by the arms in the guides in the latched and unlatched condition of the arms to the camper shell.

THE DRAWING

The invention will be further described in conjunction with the attached drawing in which.

Figures 5, 6, 7, 8:
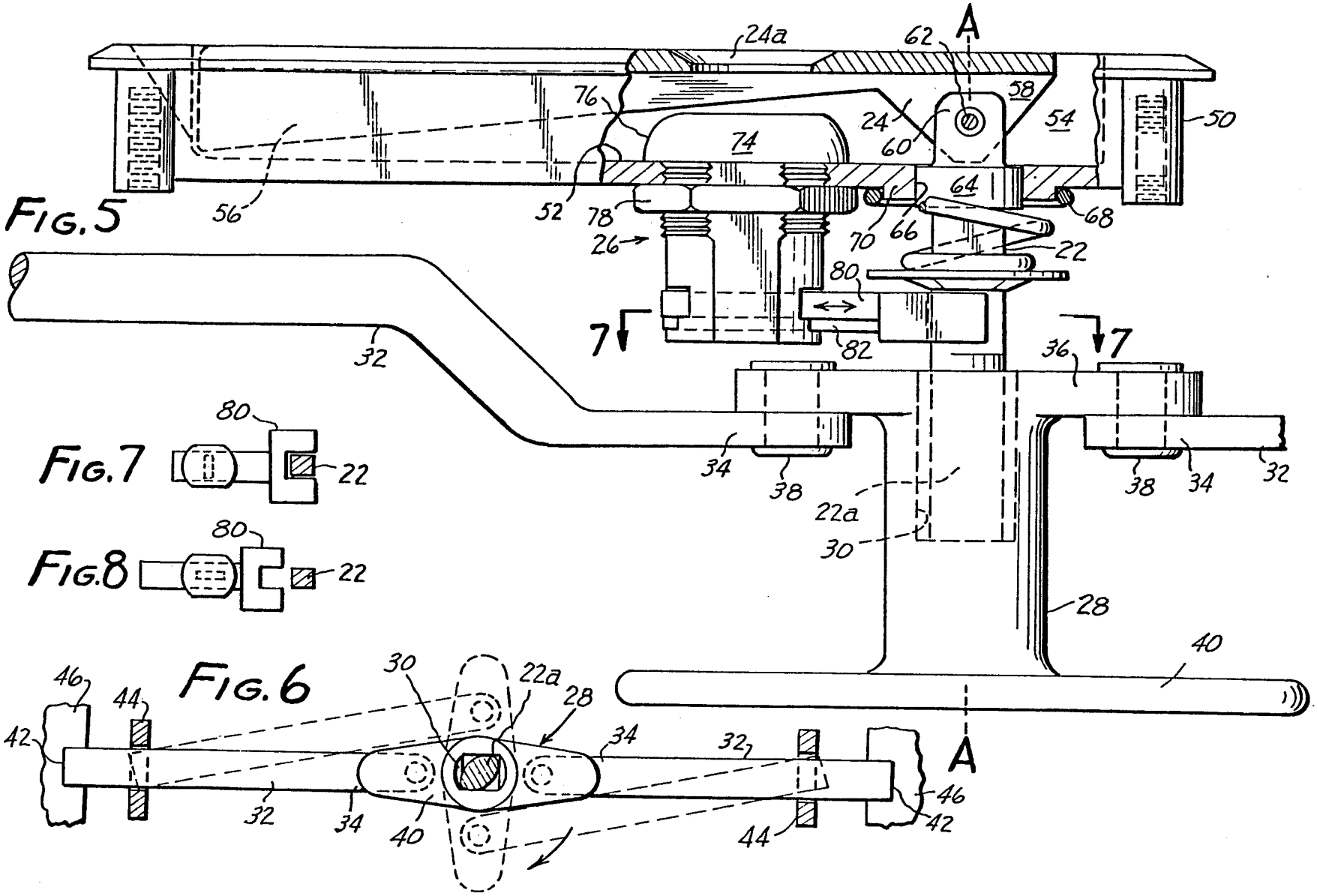
FIG. 5 is an enlarged detail view of the latch in side elevation, and partly in section.
FIG. 6 is a fragmentary view of the inside pull and latching arm assembly.
FIG. 7 is a view taken on line 7—7 in FIG. 5, and showing the shaft engaged by the latch yoke.

FIG. 8 a view like FIG. 7, with the latch yoke and shaft disengaged.

PREFERRED MODES

Figure 1:
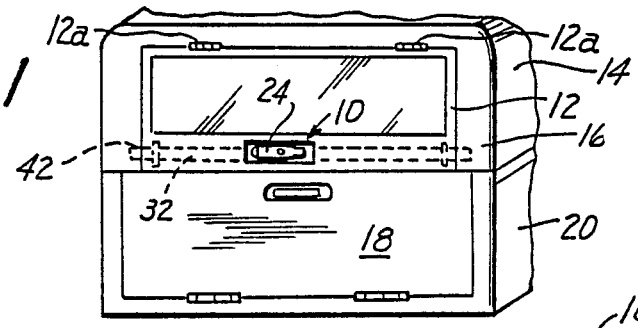
FIG. 1 is a perspective view of a camper shell installation latch of the invention.

Turning now to the drawings in detail, in FIG. 1, a security latch 10 is provided for locking overhead door 12, hinged to camper shell 14, to the shell vertical walls 16 surrounding the door. Together with tailgate 18 of the pick-up truck 20, the door 12 fully encloses the interior space of the shell 14.

With reference to FIGS. 2 to 8, the latch 10 comprises a generally square cross-section shaft 22, an outside handle 24 for rotating the shaft clockwise or counterclockwise through at least 180°, and an outside lock assembly 26 for selectively blocking rotation of the shaft. There is further provided an inside pull 28, generally T-shaped as shown, having a central bore 30 in the leg of the T, and journaled thereby on the shaft 22. A left and right hand pair of latch arms 32 are carried at their inner ends 34 on base 36 of the inside pull 28, pivotally secured by fasteners 38, whereby rotation of the inside pull whether by shaft 22 or by hand-grasping the pull handle 40 and turning in on the shaft, moves the latch arms angularly about the axis A—A of the shaft. The outer ends 42 of the latch arms 32 slide within guides 44 fixed to the inside of the door 12 and when extended fully engage a keeper structure 46 defined by the inside of the camper shell vertical walls 16. When retracted, dotted lines in FIG. 6, by rotation of the inside pull 28, the latch arm ends 42 clear the camper shell walls 16 and the door can be lifted up on hinges **12*a* (FIG. 1). The latch arms 32 cooperate with guides 44 to retain the inside pull on the shaft 22** while permitting rotation of the pull upon the shaft, for purposes to appear.

Figure 2:
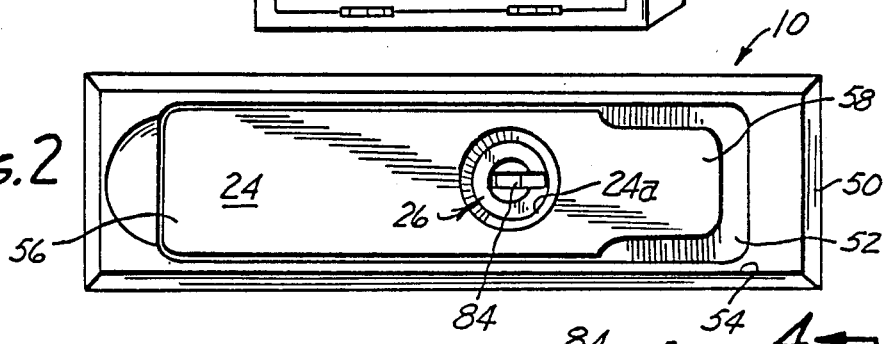
FIG. 2 is a front elevation of the invention latch in closed position flush within the latch housing.
Figure 3:
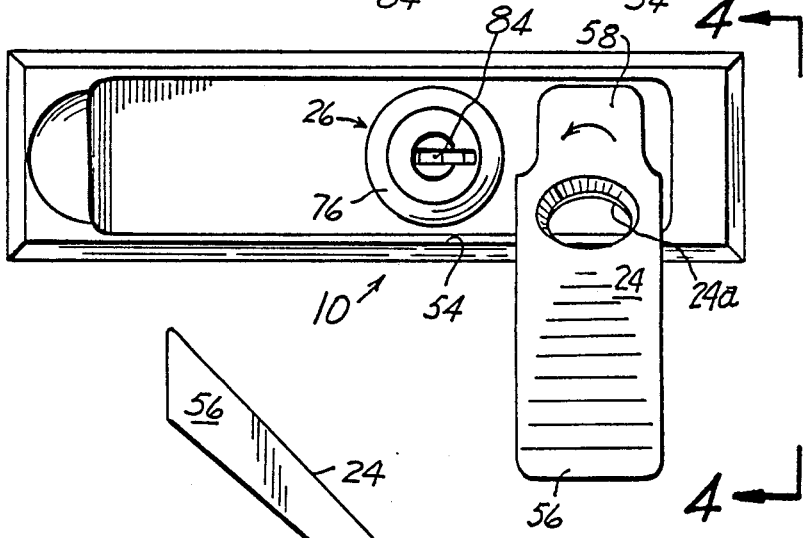
FIG. 3 is a view like FIG. 2, but with the latch outside handle the housing in latch operating position.
Figure 4:
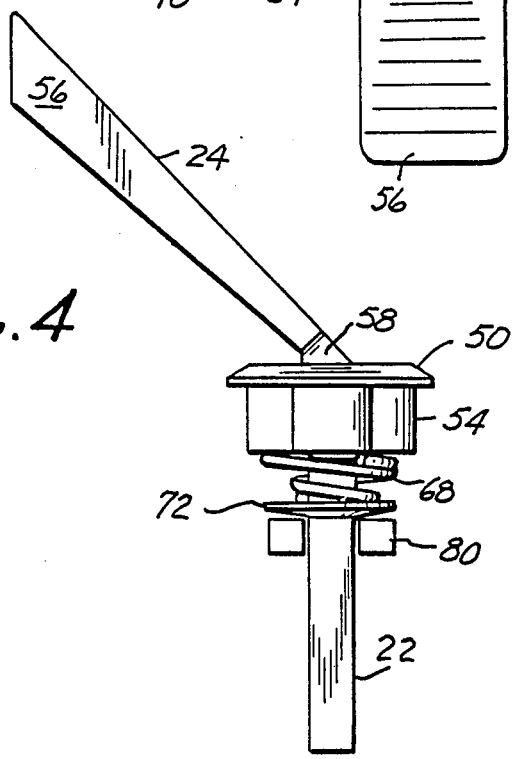
FIG. 4 is a end view of the latch taken on line 4—4 in FIG. 3, and showing the offset outside handle, shaft and compression spring assembly of the latch, and the latching yoke therebelow.

With reference now particularly to FIGS. 2–4, the latch 10 on the outside of door 12 comprises a housing 50, a shallow box having a bottom wall 52 apertured to pass shaft 22 and lock assembly 26, and side walls 54. The outside handle 24 is sized relative to the housing 50 to lie flush within the housing, the handle 24 filling the housing and lying within the plane of the housing. This snag-free and attractive enclosing of the latch handle 24, makes the invention latch a desirable lock not only for camper shell doors in replacement of old-fashioned T-handles which project out from the door, but also for cabinets and storage compartments along the sides of vehicles where lockability and freedom from dangerous projection are important concerns in choosing latchware.

The handle 24 has a tail portion 56 which can be lifted from the housing 50, by pivoting connection of handle head portion 58 with stub 60 formed integrally with the shaft 22, secured by pin 62. The shaft 22 has an enlarged circular portion 64 adjacent stub 60 thereon which journals the shaft in aperture 66 formed in the bottom wall 52 of the housing 50, as best shown in FIG. 5. A compression spring 68 anchored on boss 70 on the housing bottom wall 52 and secured by stop 72 fixed to the shaft 22, biases the handle 24 into seated position within the housing 50.

The lock assembly 26 includes a key operable plug 74 passed through the housing bottom wall 52 as shown with its keyhole defining shoulder 76 engaging the bottom wall, secured by nut 78 threaded onto the plug beyond the housing bottom wall. The handle 24 is ported at **24*a* to permit key access to the assembly 26 when the handle is within the housing 50, see FIG. 2. The lock assembly 26 is conventional and includes a yoke 80, having a spline 82, which is movable axially by rotation of the locking mechanism (not shown) of the plug 74 by a key inserted in key opening 84**.

The latch 10 is highly advantageous in that it can be locked from outside but openable from the inside. This is realized by having the inside pull 28 free to rotate in an arc of about 90° without need of the shaft on which the pull is journaled rotating as well. As will be seen, such rotation of the pull 28 carries the latch arms 32 clear of the keeper structure 46, see particularly FIG. 6, and lets the door 12 be opened from within. Such rotation of the pull 28 is independent of shaft 22 rotation by virtue of the peculiar shaping of the shaft 22 opposite the pull bore 30, and the shape of bore 30 as well.

With reference to FIG. 6 the shaft 22 has an elliptically shaped cross-section at **22*a*; the opposing bore 30 is generally rectangular and coaxial with the shaft 22. The major axis of the shaft portion 22*a*, extending from bottom right to upper left in FIG. 6, is of a dimension not to pass more than 90° in an arc left or right, given the dimensions of the bore 30 thereopposite. It will be noted that the bore 30 has a convexity opposite the shaft portion 22*a* to permit the angular movement of the pull 28 relative to the shaft portion. Thus when the pull 28 is rotated by a hand grasping the pull handle 40, the latch arms 32 carried on pull base 36 are correspondingly translationally moved into or out of keeper structure 46 engagement depending on the direction of pull 28 rotation; clockwise rotation retracting the arms 32, and counterclockwise rotation extending the arms 32, with reference to FIG. 6**.

It is noteworthy that such rotation of the pull 28 is accomplished without turning the shaft 22. Thus, one wishing an intruder free occupancy of a camper shell can lock the latch on the outside, with the door 12 open, retract the latch arms 32 by rotation of the pull 28, enter the shell, close the door, and turn the pull to reextend the latch arms into keeper structure 46 engagement. With reference to the latch structure, such activity merely involves the pull 28 rotating freely through an arc of about 90° while the shaft 22 does not move, as is made possible by the noncongruent bore 30 and shaft portion **22*a* cooperation, whereby the bore 30 can move around the shaft portion. The elliptical cross-section of the shaft portion 22*a* is typical of the shaft modification required and can be realized by beveling the alternate corners of a rectangular, e.g. square shaft, for a sufficient longitudinal distance to acommodate the length of the bore 30**.

Naturally, it is essential that the outside handle 24 be operative to retract or extend the latch arms 32 by rotation of the pull 28. This is assured by the alternate beveling of the shaft edges so that from 0° to more than 90° there is engagement between the shaft portion **22*a* and the enclosing bore, depending on the initial orientation of the pull 28, whereby an additional 90° rotation (180°) maximum, will turn the pull 28** and carry the latch arms to the desired position.

There is thus provided in accordance with the invention, a secure camper shell latch, but which is safe as well in that an enclosed person can readily open the latch although the latch is securely locked on the outside against intrusion.

I claim:

1. Security latch for camper shell doors and the like, comprising a rotatable shaft adapted to extend through the door in an axial direction to be latched, an outside housing fixed to said door and defining an an axially extended outwardly open recess, an axially extendable outside handle for rotating said shaft, said handle being relatively sized with respect to said handle recess and pivotally mounted at one end to said shaft and located at one end of said recess to lie flush within said housing recess against snagging in a first condition and for extending axially from said housing recess in a second condition corresponding to the shaft operating condition of said handle, a lock assembly for selectively blocking shaft rotation, said lock assembly being partially located within said recess spaced from said handle in a manner that said handle in its said first condition overlies said lock assembly, spring means encircling said shaft for biasing said handle into its said first condition, an inside pull journaled on said shaft, and latch means carried by said pull for latching and unlatching said door upon rotation of said inside pull by said shaft.

2. Security latch according to claim 1, in which said latch means comprises a pair of left and right latch arms adapted to engage keeper means beyond said door in the locked condition of said door.

3. Security latch according to claim 2, in which said latch arms are pivotally connected to inside pull for angular movement about the axis of said shaft.

4. Security latch according to claim 1, in which said outside handle is fixed to said shaft at one end in shaft rotating relation and is apertured in registration with said outside lock assembly to permit access thereto.

5. Security latch according to claim 4, including also a yoke partially surrounding said shaft, and in which said spring means comprises compression spring means centered on said shaft between said housing and said yoke to bias said handle toward said housing.

6. Security latch according to claim 5, in which said housing includes a mounting boss for said spring for centering said spring on said boss.

* * * * *